United States Patent [19]

Pease

[11] 4,363,337

[45] Dec. 14, 1982

[54] FLUID CONTROL VALVE AND INLET FITTING ASSEMBLY

[76] Inventor: James F. Pease, 5805 Folkestone Dr., Dayton, Ohio 45459

[21] Appl. No.: 252,074

[22] Filed: Apr. 8, 1981

Related U.S. Application Data

[63] Continuation-in-part of Ser. No. 25,869, Apr. 2, 1979, Pat. No. 4,266,567, which is a continuation-in-part of Ser. No. 818,433, Jul. 25, 1977, Pat. No. 4,149,554.

[51] Int. Cl.[3] ..... F16K 51/00; F16L 3/00

[52] U.S. Cl. ..... 137/343; 251/143; 29/157.1 R; 285/61; 285/202; 285/330

[58] Field of Search ..... 251/143, 148; 137/343; 285/330, 61–64, 161, 202; 29/157.1 R, 526 R

[56] References Cited

U.S. PATENT DOCUMENTS

| | | | |
|---|---|---|---|
| 1,802,353 | 4/1931 | Rousek et al. | 285/63 X |
| 1,967,297 | 7/1934 | Down | 285/61 X |
| 2,612,284 | 9/1952 | Snyder | 285/202 |
| 2,936,780 | 5/1960 | Prutt | 137/456 X |
| 3,195,561 | 7/1965 | Suvitzky | 251/143 X |
| 3,396,848 | 8/1968 | Kozel | 251/143 |
| 3,847,217 | 11/1974 | Kromer et al. | 285/61 X |
| 3,971,540 | 7/1976 | Johnson et al. | 251/143 |

*Primary Examiner*—A. Michael Chambers
*Attorney, Agent, or Firm*—Jacox & Meckstroth

[57] ABSTRACT

A solenoid actuated water control valve incorporates a molded plastic valve body which includes an inlet portion defining an inlet chamber and having a plurality of parallel spaced holes for receiving a set of screws. A drawn sheet metal tubular fitting includes a circular flange portion which is connected to a generally cylindrical internally threaded coupling portion by a polyagonal or hexagonal portion. A generally rectangular retaining bracket includes a skirt portion which surrounds the inlet portion of the valve body and is secured by the screws to the valve body. The bracket also includes a tubular socket portion which closely surrounds and mates with polyagonal portion of the fitting to prevent relative rotation.

17 Claims, 12 Drawing Figures

FLUID CONTROL VALVE AND INLET FITTING ASSEMBLY

RELATED APPLICATION

This application is a continuation-in-part of application Ser. No. 25,869, filed Apr. 2, 1979, now U.S. Pat No. 4,266,567, which is a continuation-in-part of application Ser. No. 818,433, filed Jul. 25, 1977, now issued as U.S. Pat No. 4,149,554.

BACKGROUND OF THE INVENTION

In the art of water control or fill valves commonly used in the appliance industry, it is conventional to use a pilot operated diaphragm which is controlled by a solenoid actuated plunger. In order to reduce costs of such a valve and to eliminate corrosion of the valve, the valve body is molded of thermoplastics material which forms the inlet and outlet portions of the valve body as well as a valve seat for receiving the pilot operated diaphragm. The inlet portion of the valve body defines a cylindrical passage or inlet chamber which is generally surrounded by a plurality of four parallel spaced holes. The holes receive corresponding screws which form threads within the plastic inlet portion of the valve body.

When such a pilot operated valve is used in a built-in appliance, for example, a built-in undercounter dishwashing machine, the valve is usually coupled to a tubular metal fitting such as shown in U.S. Pat. Nos. 2,936,780, 3,195,561 and 3,396,848. The tubular metal fitting is machined from solid metal bar stock and is provided with either external or internal pipe threads, for example, as shown in above U.S. Pat. Nos. 3,195,561 and 3,396,848, respectively, so that the fitting may be conveniently coupled to a water supply line.

As disclosed in these two patents, the metal fittings are machined with a shoulder having opposite flat surfaces which mate with corresponding flat edge surfaces of a hole or opening formed within a sheet metal support bracket for the valve. The mating flat surfaces are effective to transfer to the support bracket the torque applied to the fitting by a wrench during installation of the water supply line and thereby avoid transmitting the torque to or through the plastic valve body. The fittings must have a substantial wall thickness in the area of the shoulder to prevent collapsing and rotation of the fitting when a substantial torque is applied during installation of a water supply line with a wrench.

It is also common to machine the metal fitting from hexagonal bar stock in order to provide the fitting with a hexagonal flange portion and to provide the sheet metal bracket with an embossed mating hexagonal recess. The recess receives the flange portion to prevent rotation of the fitting relative to the support bracket when torque is applied to the fitting during installation of the water supply line. In order to form the hexagonal recess within the support bracket, it has been found necessary to form the support bracket from relatively heavy gauge sheet metal which significantly increases the cost of the support bracket. In addition, a relatively large press is required to press the hexagonal embossment and recess within the heavy gauge sheet metal.

SUMMARY OF THE INVENTION

The present invention is directed to an improved fluid control valve and inlet fitting assembly which, as one important feature, significantly decreases the cost of manufacturing the assembly while also providing for resisting the torque applied to the assembly during connection with a water supply line. The control valve coupling and fitting assembly also provides for high reliability in that the assembly provides for a dependable fluid-tight seal between the fitting and the inlet portion of a plastic valve body.

In accordance with one embodiment of the invention, the above features and advantages are provided by drawing a sheet of metal to form a tubular fitting having a generally cylindrical portion integrally connected to a circular radial flange portion by a polyagonal portion. The generally cylindrical portion of the drawn sheet metal fitting is provided with internal threads for connecting the fitting to the water supply line. The polyagonal portion of the tubular fitting projects through a mating polyagonal socket portion drawn from a sheet metal retaining bracket which also has a rectangular skirt portion surrounding the inlet portion of the valve body. Either the socket portion or the skirt portion of the retaining bracket may be gripped with a wrench to resist the torque applied when the water supply line is coupled to the fitting. In a modification, the sheet metal retaining bracket is drawn with a generally cylindrical portion which projects from the drawn socket portion and surrounds the drawn tubular threaded portion of the fitting to protect the threaded portion.

Other features and advantages of the invention will be apparent from the following description, the accompanying drawings and the appended claims.

DETAILED DESCRIPTION OF THE DRAWINGS

Figure 1:
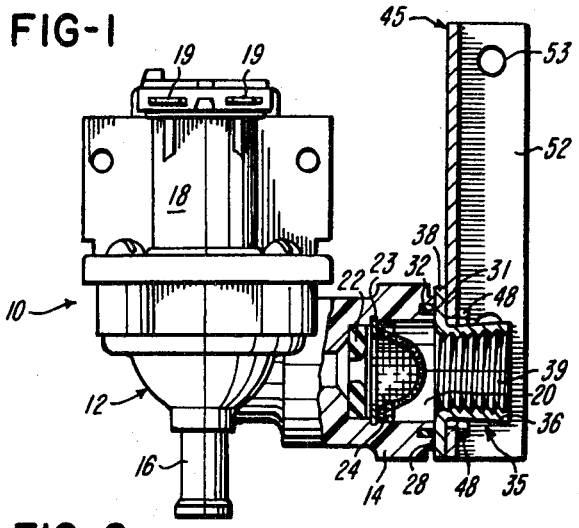
FIG. 1 is an elevational view of a fluid control valve and inlet fitting assembly and with the water inlet portion and support bracket of the assembly shown in section.
Figure 2:
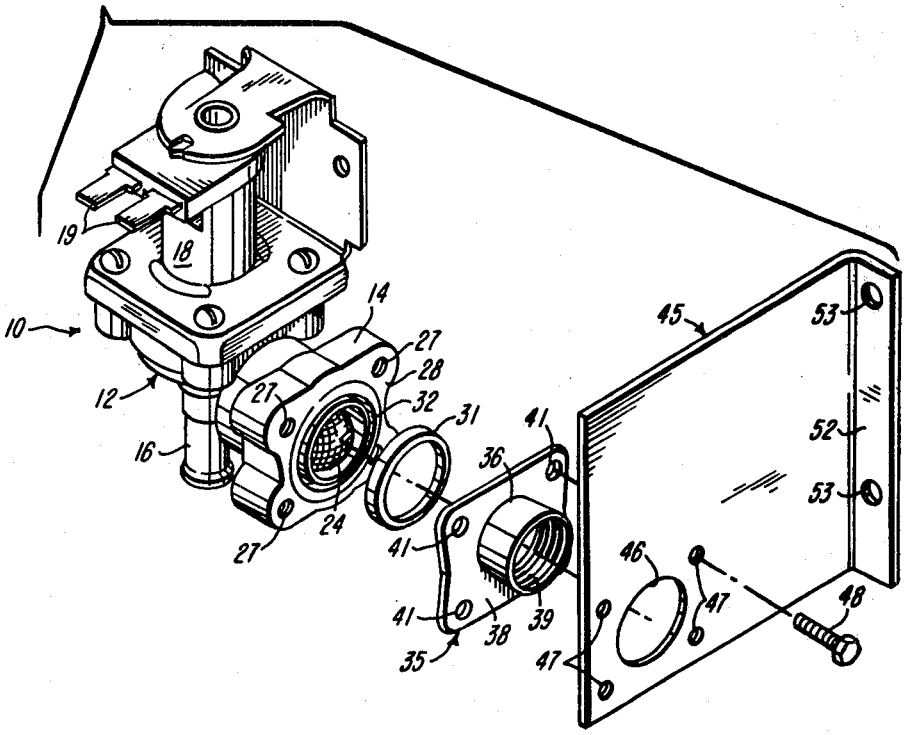
FIG. 2 is an exploded perspective of the components which form the assembly shown in FIG. 1.

Referring to the drawings, FIGS. 1 and 2 show the valve and fitting assembly which is disclosed in U.S. Pat. No. 4,149,554 issued to applicant. In this assembly, a water fill valve 10, of the type which is commonly used on an appliance such as an undercounter automatic dishwashing machine, includes a valve body 12 which is molded from a thermoplastics material and has a tubular inlet portion 14 and a tubular outlet portion 16. In a manner similar to that shown in U.S. Pat. Nos. 3,396,848 and 3,872,878, the valve body 12 also forms a circular valve seat (not shown) through which the flow of water is controlled by movement of a rubber diaphragm (not shown). The diaphragm is pilot operated by actuation of a solenoid 18 which is operated by power supply leads connected to the terminals 19 and automatically controlled by a programmed timer. The specific construction of the valve 10 forms no part of the present invention.

The inlet portion 14 of the molded plastic valve body 12 has a generally rectangular external configuration (FIG. 2) and defines an internal inlet chamber 20 which receives a pressure responsive resilient flow control washer 22, a spring C-type retaining ring 23 and a dome-shaped filter 24 constructed of a stainless steel wire mesh. A set of four parallel holes 27 (FIG. 2) are formed within the inlet portion 14 and are spaced uniformly around the inlet chamber 20. The holes 27 extend from a flat radial face 28 of the inlet portion 14, and a resilient sealing ring 31 is recessed within an annular groove 32 formed within the face 28 concentrically with the inlet chamber 20.

A tubular inlet fitting 35 is formed by drawing flat sheet metal to form a tubular portion 36 integrally connected to a radial flange portion 38 so that the tubular portion and flange portion have generally a uniform wall thickness. The tubular portion 36 has a slight tapered or frusto-conical configuration and increases in diameter towards the right end (FIG. 1) of the fitting, and the tubular portion 36 is formed with internal pipe threads 39. The flange portion 38 of the sheet metal fitting 35 has a generally rectangular outer configuration (FIG. 2) which conforms generally to the configuration of the inlet portion 14 of the body 12 and is provided with a corresponding set of holes 41 which align with the holes 27 within the inlet portion.

The fill valve 10 is supported by a formed sheet metal bracket 45 which has a hole or opening 46 for receiving the tubular portion 36 of the fitting 35. The support bracket 45 also has a set of holes 47 which align with the holes 41 in the fitting 35 and with the holes 27 in the inlet portion 14 of the valve body 12. A set of four sheet metal screws 48 extend through the corresponding aligned holes 47 and 41 and form threads within the holes 27 of the plastic inlet portion 14. When the screws 48 are tightened (FIG. 1), the flange portion 38 of the fitting 35 is clamped between the inlet portion 14 of the valve body and the support bracket 45, and the resilient ring 31 forms a fluid-tight seal between the face 28 of the inlet portion 14 and the flange portion 38 of the inlet fitting 35. The support bracket 45 includes a right angle flange portion 52 which is provided with a set of vertically spaced holes 53 for securing the bracket 45 to the frame of the dishwashing machine.

When a water supply line is coupled to the inlet fitting 35, it is apparent that the torque applied to the fitting 35 in response to tightening of a pipe coupling, is transferred through the set of screws 48 to the support bracket 45 so that none of the torque is applied to the plastic valve body 12. Furthermore, as a result of the substantial radial spacing of the holes 41 relative to the center axis of the tubular inlet fitting 35, the fitting 35 can resist substantial torque without any possibility of shearing the screws 48. The construction of the fitting 35 from sheet metal also significantly reduces the manufacturing cost of the fitting in comparison with conventional fittings which are machined from solid metal bar stock. In addition, the use of the screws 48 for transmitting the torque from the fitting 35 to the support bracket 45 provides for substantial distribution of the torque and permits forming of the support bracket from relatively thin sheet metal, thereby significantly reducing the manufacturing cost of the bracket. The fitting 35 also eliminates the costly operation of embossing the support bracket.

Figure 3:
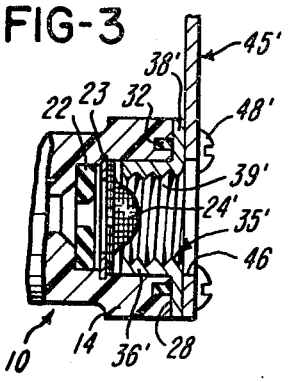
FIG. 3 is a fragmentary section similar to FIG. 1 and showing the fitting having a tubular portion which projects into the inlet portion of the valve body.

Referring to FIG. 3 which shows a modification of a fill valve and fitting assembly, an inlet fitting 35' is constructed substantially the same as the inlet fitting 35 described above with the exception that the tubular portion 36' of the fitting 35' projects inwardly into the inlet chamber 20 defined by the valve body inlet portion 14. Thus the drawn sheet metal tubular portion 36' has a slight taper which corresponds in direction to the taper of the standard pipe threads 39', and the tubular portion terminates adjacent the fine wire mesh filter screen 24'. The flange portion 38' has the same configuration as the flange portion 38 of the fitting 35 and includes corresponding holes 41 for receiving the screws 48' which extend through the aligned holes 47 within the bracket 45 and are threaded into the holes 27 within the inlet portion 14 of the valve body 12. Since the tubular portion 36' of the fitting 35' projects inwardly into the inlet portion 14 of the valve body 12, the tubular portion 36' is not exposed for gripping by a pipe wrench or a similar gripping tool. This feature is desirable since the fitting 35' is drawn from sheet metal, and the tubular portion 36' has a relatively thin wall thickness which could possibly be deformed by the unnecessary attachment of a pipe wrench.

Figure 4:
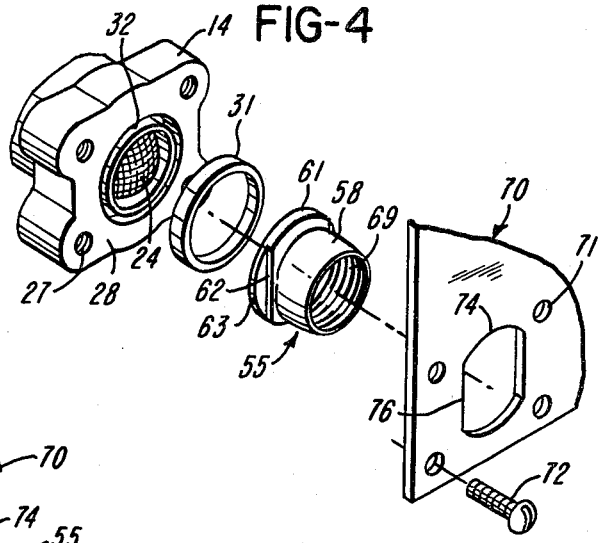
FIG. 4 is a fragmentary exploded perspective view of a modified fluid control valve and fitting assembly.
Figure 5:
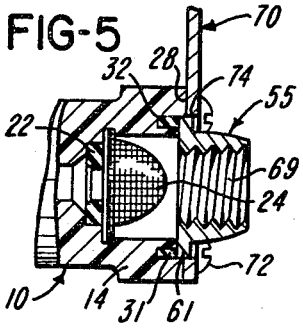
FIG. 5 is a fragmentary section of the assembly shown in FIG. 4.

Another valve and fitting assembly is illustrated in FIGS. 4 and 5. In this assembly, an inlet fitting 55 is progressively stamped or formed from a sheet metal disc 56 (FIG. 6) to provide the fitting with a tubular portion 58 projecting from an integral flange portion 61. In the progressive stamping or forming steps, the flange portion 61 is stamped or pressed to form a pair of diametrically opposite flat surfaces 62 which extend from corresponding relatively thin sections 63 of the flange portion 61. As illustrated, the flange portion 61 has a thickness of approximately 0.075 inch, and the sections 63 have a thickness of approximately 0.020 inch.

Figure 6:
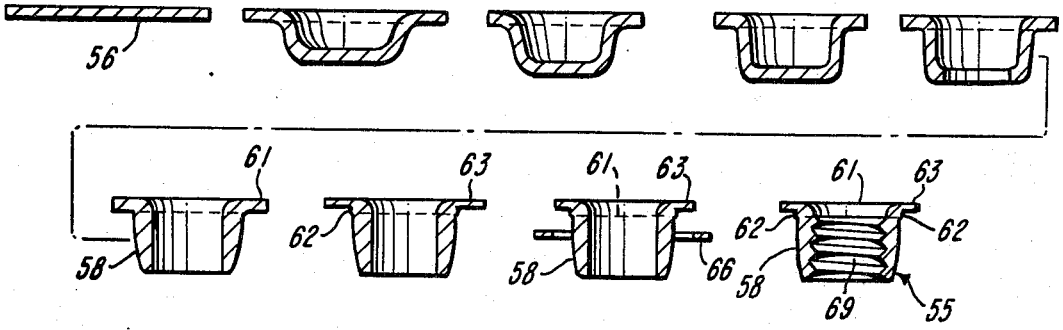
FIG. 6 illustrates the progressive steps for drawing the fitting shown in FIGS. 4 and 5.

As shown by the progressive forming steps in FIG. 6, after the flange sections 61 and the flat surfaces 62 are pressed into the metal, the flange portion 61 is trimmed to produce a precisely circular flange portion 61 including the flange sections 63. The ring 66 trimmed from the flange portion 61 is collected as scrap, and the tubular portion 58 is then provided with internal pipe threads 69 which may be roll-formed or tapped as a secondary operation.

As shown in FIG. 4, the valve body is supported by a sheet metal bracket 70 which has a set of holes 71 for receiving corresponding screws 72. The screws 72 are threaded into the holes 27 of the valve body inlet portion 14 to secure the inlet portion 14 rigidly to the bracket 70. A part-circular hole or opening 74 is formed within the sheet metal bracket 70, and the opening 74 is partially defined by opposing flat surfaces 76 which mate or conform to the corresponding flat surfaces 62 pressed into the fitting 55. The diameter of the part-circular surfaces forming the opening 74 is slightly greater than the diameter of the circular flange portion 61 of the fitting 55 so that part of the flange portion 61 projects into the opening 74.

As shown in FIG. 5, the valve body inlet portion 14 has a slight circular recess within the face 28 adjacent the groove 32, and the recess receives part of the flange portion 61 of the inlet fitting 55 by having a depth corresponding to the thickness of the flange sections 63. FIG. 5 also shows the final assembly of the bracket 70 and inlet fitting 55 to the valve body inlet portion 14 with the resilient ring 31 forming a water-tight seal between the flange portion 61 and the valve body inlet portion 14. As a result of the drawn circular flange portion 61, the sheet metal fitting 55 provides for a further cost savings over the savings provided by the drawn sheet metal fitting 35 described above in connection with FIGS. 1 and 2.

Figure 7:
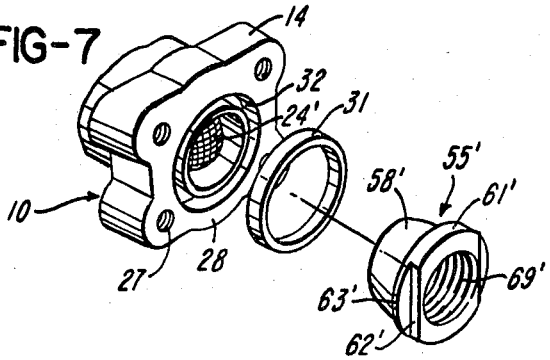
FIGS. 7 and 8 are views similar to FIGS. 4 and 5 and showing another modification of the valve and fitting assembly.
Figure 8:
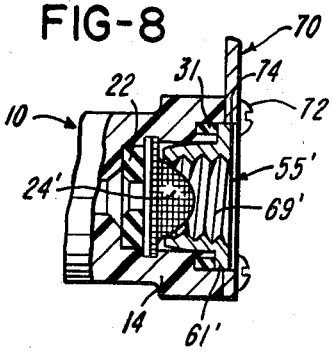

A modification of the fitting 55 and its assembly between the valve body 12 and support bracket 70 are illustrated in FIGS. 7 and 8. In this modification, a fitting 55' is progressively formed or stamped from sheet metal in the same manner as the fitting 55. However, in this modification the flat surfaces 62' are formed or pressed into the opposite side of a circular flange portion 61', and the tapered pipe threads 69' extend from the flange portion 61' so that a water supply line pipe or fitting is initially threaded into the end having the flange portion 61'.

As shown in FIG. 8, the fitting 55' is assembled between the bracket 70 and the valve body inlet portion 14 in the same manner as the fitting 35' is assembled, as discussed above in connection with FIG. 3. That is, the tubular portion 58' of the fitting 55' projects inwardly into the chamber 20, and the flange portion 61' projects both into the opening 74 within the bracket 70 and into the recess within the face 28 of the valve body. As mentioned above, the assembly of the fitting 55', as shown in FIG. 8, with the tubular portion 58' projecting into the valve body 12, eliminates the possibility of the tubular portion being damaged by being hit or by the attachment of a wrench when the fitting is connected to a water supply line. In addition, the slight taper of the tubular portion 58' is in the same direction as the taper of the standard pipe threads 59' which is desirable for maintaining a substantially uniform wall thickness along the tubular portion 58'.

Figure 9:
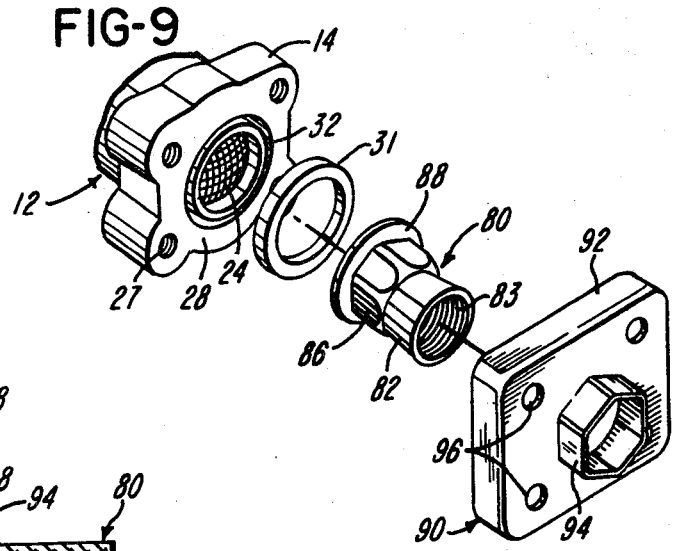
FIG. 9 is an exploded perspective view of a valve and fitting assembly constructed in accordance with the present invention.
Figure 10:
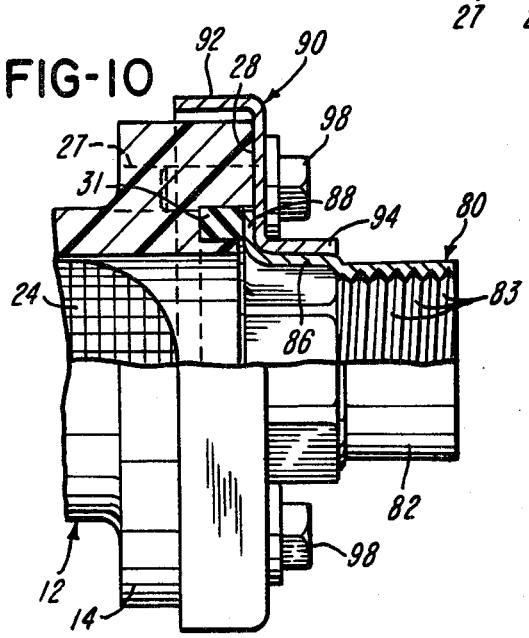
FIG. 10 is an enlarged part axial section of a portion of the assembly shown in FIG. 9.
Figure 11:
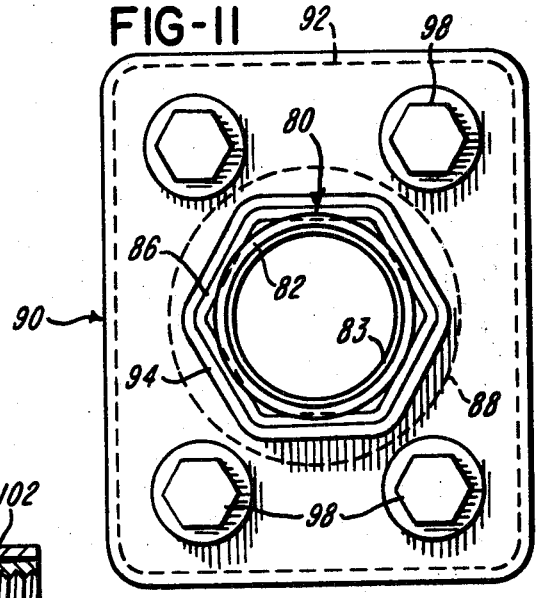
FIG. 11 is an end view of the assembly portion shown in FIG. 10.

Referring to FIGS. 9–11 which illustrate a fluid control valve and inlet fitting assembly constructed in accordance with the present invention, a tubular inlet fitting 80 is drawn from 0.050 inch brass sheet metal in a manner similar to the above described method for drawing the fitting 55. The fitting 80 includes a generally cylindrical or slightly taperd coupling portion 82 having internal pipe threads 83 which are roll-formed into the fitting after it is drawn since the metal thickness is too thin to permit tapping of the threads. The tubular coupling portion 82 projects from a slightly larger polyagonal or hexagonal portion 86 which connects with an outwardly projecting circular flange portion 88. The outer diameter of the flange portion 88 is the same as the outer diameter of the flange portion 61 of the fitting 55 and projects into the circular recess formed within the end surface 28 of the inlet portion 41 of the valve body 12. As also described above in connection with FIGS. 4 and 5, the resilient ring 31 forms a fluid-tight seal between the valve body and the flange portion 88 of the sheet metal fitting 80.

The assembly shown in FIGS. 9–11 also includes a drawn sheet metal retaining plate 90 which is generally rectangular in configuration and is preferably formed from 0.050 steel. The plate 90 includes a rectangular skirt portion 92 surrounding the inlet portion 14 of the valve body. The retaining plate 90 also includes an axially projecting polyagonal or hexagonal socket portion 94 which closely surrounds and mates with the hexagonal portion 86 of the fitting 80 so that the fitting 80 is prevented from rotating relative to the retaining plate 90. A set of holes 96 are formed within the retaining plate 90 in alignment with the holes 27 within the inlet valve body portion 14, and the retaining plate is rigidly secured to the inlet portion 14 by a set of screws 98.

When it is desired to connect the water supply line to the valve and fitting assembly shown in FIGS. 9–11, a wrench is placed either on the skirt portion 92 or the socket portion 94 of the retaining plate 90, and a threaded nipple on the end of the water supply line is threaded into the coupling portion 82 of the fitting 80. The wrench on the retaining plate 90 is effective to counteract or resist the torque applied to the fitting 80 to form a water-tight seal or connection between the water supply line and the coupling portion 82 of the fitting 80. Thus none of the torque is transmitted to or through the plastic valve body 12. The assembly of FIGS. 9–11 provides for minimizing the thickness and volume of the brass sheet metal required for producing the fitting 80 and for also minimizing the thickness of the steel sheet metal required for producing the retaining plate 90. The assembly also provides for a substantially high transmission of torque between the fitting 80 and the retaining plate 90 without stripping or collapsing or otherwise damaging either part.

Figure 12:
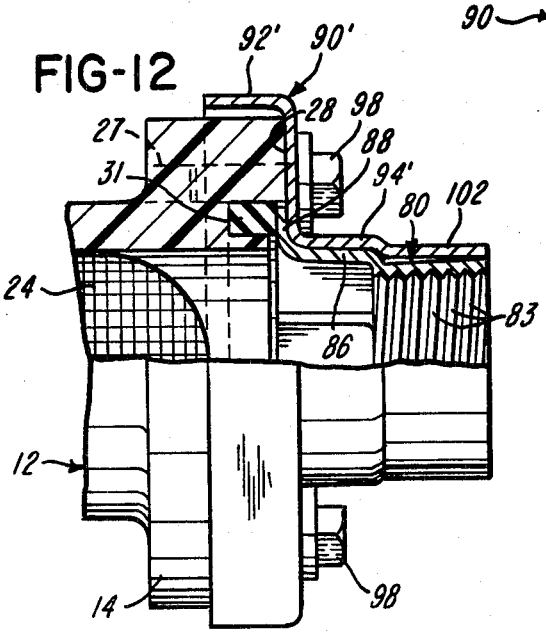
FIG. 12 is a view similar to FIG. 10 and showing a modification of the assembly.

The assembly illustrated in FIG. 12 is substantially the same as the assembly shown in FIG. 10 and accordingly, the same reference numbers are used for the identical components or parts. The only difference in the assembly shown in FIG. 12, is that the retaining plate 90' includes a generally cylindrical portion 102 which projects from the polyagonal or hexagonal portion 94' and surrounds the internally threaded coupling portion 82 of the fitting 80. Thus the tubular or cylindrical portion 102 of the retaining plate 90' provides a protection for the coupling portion 82 of the fitting 80 to prevent the coupling portion from being damaged during handling or installing the water inlet fill valve or when the water supply line is being connected by wrenches to the coupling portion 82 of the fitting 80.

Additionally, the tubular portion 102 prevents the coupling portion 82 of the fitting 80 from being expanded into an oversize condition which could result from a threaded nipple being forced or tightened too far into the coupling portion 82.

While certain assemblies herein described and their method of construction constitute preferred embodiments of the invention, it is to be understood that the invention is not limited to these precise assemblies and methods, and that changes may be made therein without departing from the scope and spirit of the invention as defined in the appended claims.

The invention having thus been described, the following is claimed:

1. In a valve assembly for controlling the flow of a fluid and including a molded plastic valve body having an inlet portion defining an inlet and an outlet portion defining an outlet and means forming a valve seat therebetween, means supported by said valve body and cooperating with said valve seat for controlling the flow of fluid from said inlet to said outlet, a metal fitting including a tubular threaded portion projecting from an integral flange portion disposed adjacent said inlet portion of said valve body, means forming a fluid-tight seal between said flange portion and said inlet portion of said valve body, a sheet metal retaining bracket having an aperture aligned with said tubular portion of said fitting, and means for securing said bracket to said valve body, the improvement wherein said fitting comprises a drawn sheet metal tubular fitting including a tubular portion integrally connecting said flange portion to said tubular threaded portion, said connecting portion having a non-circular cross-sectional configuration, said retaining bracket including an axially projecting drawn sheet metal tubular socket portion defining said aperture and having a non-circular cross-sectional configuration, and said socket portion closely surrounding said tubular connecting portion of said fitting and cooperatively shaped to prevent rotation of said fitting relative to said retaining bracket.

2. A valve assembly as defined in claim 1 wherein said retaining bracket includes a skirt portion receiving and projecting adjacent said inlet portion of said valve body, and said skirt portion forms generally parallel outer surfaces adapted to receive a wrench.

3. A valve assembly as defined in claim 2 wherein said skirt portion surrounds said inlet portion of said valve body.

4. A valve assembly as defined in claim 2 wherein said skirt portion of said retaining bracket is generally rectangular in configuration.

5. A valve assembly as defined in claim 1 wherein said tubular connecting portion of said fitting and said tubular socket portion of said bracket have corresponding adjacent and parallel generally flat mating surfaces.

6. A valve assembly as defined in claim 1 wherein said tubular connecting portion of said fitting and said tubular socket portion of said bracket have corresponding and mating hexagonal cross-sectional configurations.

7. A valve assembly as defined in claim 1 wherein said tubular socket portion of said bracket has generally parallel outer surfaces adapted to receive a wrench.

8. In a valve assembly for controlling the flow of a fluid and including a molded plastic valve body having an inlet portion defining an inlet and an outlet portion defining an outlet and means forming a valve seat therebetween, means supported by said valve body and cooperating with said valve seat for controlling the flow of fluid from said inlet to said outlet, said inlet portion including a plurality of parallel spaced holes disposed generally around said inlet, a metal fitting including a tubular threaded portion projecting from an integral flange portion disposed adjacent said inlet portion of said valve body, means forming a fluid-tight seal between said flange portion and said inlet portion of said valve body, a sheet metal retaining bracket having an aperture aligned with said tubular portion of said fitting and a plurality of holes aligned with said holes within said inlet portion of said valve body, and a plurality of threaded fasteners extending within said holes for securing said bracket to said valve body, the improvement wherein said fitting comprises a drawn sheet metal tubular fitting including a tubular portion integrally connecting said flange portion to said threaded tubular portion, said connecting portion having a polyagonal cross-sectional configuration, said retaining bracket including an axially projecting drawn sheet metal tubular socket portion defining said aperture and having a polyagonal cross-sectional configuration, and said socket portion closely surrounding and mating with said tubular connecting portion of said fitting to prevent rotation of said fitting relative to said retaining bracket.

9. In a valve assembly for controlling the flow of a fluid and including a molded plastic valve body having an inlet portion defining an inlet and an outlet portion defining an outlet and means forming a valve seat therebetween, means supported by said valve body and cooperating with said valve seat for controlling the flow of fluid from said inlet to said outlet, a metal fitting including a tubular threaded portion projecting from an integral flange portion disposed adjacent said inlet portion of said valve body, means forming a fluid-tight seal between said flange portion and said inlet portion of said valve body, a sheet metal retaining bracket having an aperture aligned with said tubular portion of said fitting, and means for securing said bracket to said valve body, the improvement wherein said fitting comprises a drawn sheet metal tubular fitting including a tubular portion integrally connecting said flange portion to said tubular threaded portion, said connecting portion having a non-circular cross-sectional configuration, said retaining bracket including an axially projecting tubular socket portion defining said aperture and having a non-circular cross-sectional configuration, said socket portion closely surrounding said tubular connecting portion of said fitting with said tubular connecting portion and said tubular socket portion being cooperatively shaped to prevent rotation of said fitting relative to said retaining bracket, and said retaining bracket further including a drawn tubular portion projecting axially from said socket portion and closely surrounding said threaded portion of said fitting.

10. In a method of constructing a valve and inlet fitting assembly and including the steps of molding a valve body of plastics material with an inlet portion defining an inlet and an outlet portion defining an outlet, mounting on said valve body means for controlling the flow of fluid from said inlet to said outlet, forming a metal fitting including a tubular threaded portion projecting from an outwardly projecting integral flange portion, positioning said flange adjacent said inlet portion of said valve body, forming a fluid-tight seal between said flange portion and said inlet portion, forming a sheet metal retaining bracket having an aperture aligned with said tubular portion of said fitting, and securing said bracket to said valve body and said flange portion disposed therebetween, the improvement comprising the steps of drawing a sheet of metal to form said tubular inlet fitting, forming said fitting with a non-circular sheet metal tubular portion connecting said flange portion to said threaded portion, drawing said retaining bracket to form a corresponding non-circular sheet metal tubular socket portion closely surrounding and cooperatively shaped with said tubular connecting portion of said fitting, and interfitting said non-circular connecting portion of said fitting with said non-circular socket portion of said bracket to prevent relative rotation between said bracket and said fitting.

11. A method as defined in claim 10 and including the steps of forming said tubular socket portion of said bracket and said tubular connecting portion of said fitting with corresponding and mating adjacent flat wall sections.

12. A method as defined in claim 11 and including the step of forming said connecting portion of said fitting and said socket portion of said bracket with corresponding and mating hexagonal cross-sectional configurations.

13. A method as defined in claim 10 and including the step of drawing said retaining bracket to form said socket portion with a polyagonal cross-sectional configuration.

14. A method as defined in claim 10 and including the step of drawing said retaining bracket to form a skirt portion receiving said inlet portion of said body.

15. A method as defined in claim 14 and including the step of forming said skirt portion with generally parallel opposite outer side surfaces adapted to receive a wrench.

16. A method as defined in claim 10 and including the step of extending said retaining bracket from said socket portion to form a drawn sheet metal tubular protecting portion closely surrounding said threaded portion of said fitting.

17. A method as defined in claim 10 including the step of roll-forming the threads within said tubular portion of said fitting.

* * * * *